US005533309A

United States Patent [19]

Rivin

[11] Patent Number: 5,533,309

[45] Date of Patent: Jul. 9, 1996

[54] METHOD AND MEANS FOR ENHANCEMENT OF BEAM STIFFNESS

[76] Inventor: Evgeny I. Rivin, 30236 Southfield Rd., #249, Southfield, Mich. 48076

[21] Appl. No.: 176,247

[22] Filed: Jan. 3, 1994

[51] Int. Cl.[6] ..... E04C 5/08

[52] U.S. Cl. ..... 52/223.8; 52/2.11; 52/223.1; 52/738.1

[58] Field of Search ..... 52/1, 2.11, 2.13, 52/223.1, 223.8, 232, 168, 720.1, 736.1, 736.3, 737.1, 737.4, 738.1, 739.1; 62/529, 530; 420/557, 900

[56] References Cited

U.S. PATENT DOCUMENTS

| | | | |
|---|---|---|---|
| 2,099,470 | 11/1937 | Coddington | 52/727 X |
| 2,104,506 | 1/1938 | Coddington | 52/727 X |
| 2,109,937 | 3/1938 | Trbojevich | 52/720 X |
| 2,210,553 | 8/1940 | Miller | 52/223.1 X |
| 3,059,452 | 10/1962 | Griffin | 62/529 X |
| 3,528,206 | 9/1970 | Baird | 52/1 |
| 3,566,000 | 2/1971 | Maurer et al. | 52/727 X |
| 3,810,337 | 5/1974 | Pollard | 52/223.8 |
| 3,858,374 | 1/1975 | Ben-Zvi | 52/2.11 X |
| 3,925,110 | 12/1975 | Prematta et al. | 420/557 X |
| 4,411,114 | 10/1983 | Wurtinger et al. | 52/727 X |
| 4,685,253 | 8/1987 | Bitterly | 52/2.11 |
| 4,905,441 | 3/1990 | Landers | 52/232 X |
| 4,910,978 | 3/1990 | Gordon et al. | 62/530 |
| 5,100,615 | 3/1992 | Oguro et al. | 420/900 X |
| 5,117,606 | 6/1992 | Mikami | 52/727 |
| 5,314,005 | 5/1994 | Dobry | 62/530 X |
| 5,389,333 | 2/1995 | Li et al. | 420/900 X |

FOREIGN PATENT DOCUMENTS

| | | | |
|---|---|---|---|
| 175637 | 10/1965 | U.S.S.R. | 52/2.11 |

OTHER PUBLICATIONS

"Diaphragm Actuator", G. A. Lemke, IBM Technical Disclosure Bulletin, vol. 8, No. 6, Nov. 1965.

*Primary Examiner*—Carl D. Friedman
*Assistant Examiner*—Kevin D. Wilkens

[57] ABSTRACT

A beam-like structural component has a tubular shape with both ends closed. The internal cavity of the tubular element is filled with core material which can undergo transformation leading to increasing its specific volume and thus to exerting pressure on the end closures of the tubular element and inducing its stretching along the axis. This results in increasing bending stiffness of the beam-like component. The transformation can be thermal expansion, phase transformation (melting or solidification); time-dependency effects after solidification; change in crystallic structure, absorption of gases or fluids, etc. In case of using liquid core materials, the tubular element is reinforced in radial directions. A clearance can be left between the core material and the tubular element. This clearance may be filled with a lubricant or elastic spacers.

19 Claims, 1 Drawing Sheet

METHOD AND MEANS FOR ENHANCEMENT OF BEAM STIFFNESS

FIELD OF THE INVENTION

The present invention relates to structures and to beam-like structural components.

BACKGROUND OF THE INVENTION

Undesirable deformations of stiffness—critical structural components under load can be caused by tension, compression, bending, and torsion (twisting). The largest deformations are due to bending since it is causing angular distortions in the component being deformed and thus displacements of the remote points of the component can be amplified by projections of these angular distortions. Especially pronounced these displacements are in cantilever components which have long unsupported spans.

It is known from the Strength of Materials that stiffness of a structural component (i.e., the magnitude of force, moment, or torque needed to generate a unit of deformation) is determined by its geometry (for bending—cross sectional moment of inertia, position of application point of the forcing factor, and position of the point in which the deformation is measured) and by modulus of elasticity (Young's modulus) of the material. While the geometry is usually determined by the design considerations, Young's modulus is constant for a given family of materials and cannot be changed by alloying or by heat treatment, contrary to strength properties. For example, while yield strength values for high strength steel, high strength aluminum brands are up to about ten times higher than the yield strength values for ordinary steel, aluminum brands, respectively, values of Young's moduli for both high strength and ordinary brands are essentially the same. As a result, enhancement of stiffness requires either "beefing up" of structural designs thus increasing their dimensions, weight, and cost, or use of expensive materials having high Young's moduli (e.g., sintered tungsten carbide), which usually also have higher density and lead to increasing weight of the structural components. If stiffness enhancement is needed for increasing values of natural frequencies of the structure, weight increase can negate effects of the enhanced stiffness. In many cases design parameters of the structure are sacrificed since the desired stiffness cannot be achieved within the prescribed parameters of size and weight. In some instances, low stiffness can be compensated by active (servo-controlled) systems, which add cost, complexity, and weight to the structure while having their own performance limitations and reliability problems, and also require a constant energy supply for operation.

It is known that bending stiffness of slender components can be enhanced without changing their geometry and material by judicious application of forces. An example of such approach is a string of string musical instruments, e.g. guitar. Stretching of the string leads to a higher pitch (higher natural frequencies) without changing its mass, thus it effectively increases bending stiffness of the string. While prestressing (the "guitar string" effect) is used in design practice to enhance structural stiffness, its application is limited since in many cases external forces cannot be continuously applied to structural components, especially to cantilever components. Some examples of self-contained systems in which permanent tension of external parts of a structural component is compensated by permanent compression of its internal parts are given in the book by E. Rivin, "Mechanical Design of Robots", McGraw-Hill, 1988. In one example the internal part is a rod which can be compressed by using a threaded connection, thus causing stretching of the external part. In this system bending stiffness of the external part is increasing while bending stiffness of the internal part (rod) is decreasing due to their stretching, compression, respectively. However, since bending stiffness of the internal layers of a beam does not contribute significantly to its overall stiffness, the overall stiffness of the beam is increasing.

Some of shortcomings of such self-contained systems are their complexity and also a danger of buckling of the internal parts under compressive forces.

Another shortcoming is a difficulty to apply a desired degree of preload since it requires a precise deformation of the internal member.

Yet another shortcoming is a difficulty to use this technique to a beam with a complex (not round or square) cross section.

The present invention addresses the inadequacies of the prior art by providing a method for enhancement of beam stiffness in bending by using transformations (thermal expansion, phase transformation, chemical changes) of a medium filling the internal space of the beam. Since these transformations are usually accompanied by volume changes, volume increase of the media locked in the enclosed space inside the beam results in generating of tensile stresses in the surrounding beam structure and thus, in the stiffness increase.

These and other advantages of the present invention will be readily apparent from the drawings, discussion, and claims which follow.

SUMMARY OF THE INVENTION

The present invention provides a method and means for enhancement of stiffness of beam-like structural components for bending deformations by using tensile preloading of areas of the structural component which are determining its overall bending stiffness. The tensile preloading is affected by modification of condition of the material constituting internal parts within the treated component which are not playing a significant role in its bending stiffness breakdown. The utilized condition modification is of such nature which results in increasing specific volume of the affected material. This modification can be thermal expansion, phase transformation (melting or solidification); utilization of time-dependent effects following solidification ("post-solidification expansion"); change in crystallic structure due to heat treatment (e.g., transformation from martensite to austenite in iron alloys, or transformation from white to gray tin); absorption of gases by solid materials resulting in mechanical or chemical bonding of such gases (e.g., absorption of hydrogen by titanium and other metals), etc.

The proposed component design is essentially composed of an external part made of the basic structural material of the component which provides its strength and stiffness properties and is hollow inside, and a transformable material filling the inside cavity and constituting an internal part along a large portion of the external part's length. Before, during, or after assembling of the external and internal parts, transformation of the transformable material is affected by applying an appropriate condition (temperature, pressure, combination and variation of both, etc.).

Some means providing for easy shear deformation or sliding between the external and internal parts, such as a clearance, a lubricant, or an easily deformable interface, such as elastomeric spacers, may be introduced in the component design.

Some means providing for enhancement of buckling resistance of the internal part, such as spacers between the external and internal parts, may also be introduced in the component design.

BRIEF DESCRIPTION OF THE DRAWINGS

The present invention can best be understood with reference to the following detailed description and drawings in which.

DETAILED DESCRIPTION OF THE PREFERRED EMBODIMENTS

Figure 1:
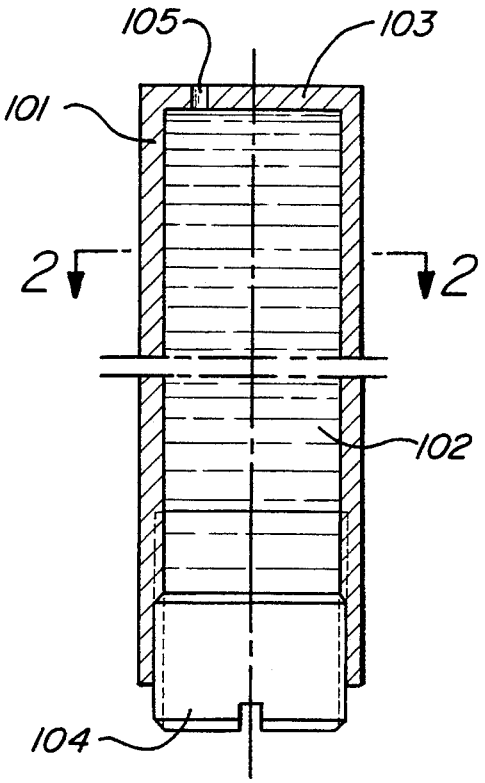
FIG. 1 is an axial section of one of the embodiments of the proposed invention in which the transformable material is solid while in the stressed condition.

Throughout the following detailed description, like reference numerals are used to refer to the same element of the present invention shown in multiple embodiments thereof.

Figure 2:
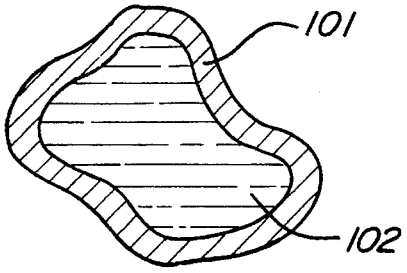
FIG. 2 is a cross section of the embodiment shown in FIG. 1.

FIG. 1 illustrates the proposed method of stiffness enhancement. Slender structural element 101 is of a tubular shape as further illustrated in FIG. 2 which presents cross section of element 101 by plane A—A. Internal cavity of tubular element 101 is filled with transformable material 102 which is enclosed inside tubular element 101. While integral top cover 103 and threaded plug 104 are shown in FIG. 1 as the closing components, other known appropriate means can be used for this purpose.

An example of the transformable material is common water. During phase transformation into solid state (ice) the volume of water is increasing about 9%. If the tubular element is in vertical position and the source of freezing temperature is applied from the bottom end of tubular element 101 and is gradually moving upwards, then there will be no significant bulging of the ice column being generated, provided that water initially did not completely fill the tubular element and the air can bleed through hole 105. After the freezing process reached the top section of tubular element 101, expansion of the ice column will be prevented by cover 103 thus applying tensile force to tubular element 101 and compressive force to the ice column.

It is known that bending stiffness $K_b$ of a beam under compression by an axial force P is $$K_b=K_{b0}(1-P/P_{cr}) \quad (1)$$

where $K_{b0}$ is the initial bending stiffness of the beam (with P=0), and $P_{cr}$ is critical (buckling, Euler) magnitude of the compressive force at which the beam buckles (e.g., see S. P. Timoshenko and J. M. Gere, Theory of Elastic Stability, McGraw-Hill, N.Y., 1961). Analogously, if the axial force is of tensile character, then $$K_b=K_{b0}(1+P/P_{cr}) \quad (2)$$

Thus, stiffness of tubular element 101 is increasing under the tensile force applied by the expanding ice column in accordance with formula (2) while stiffness of the ice column would be less than its stiffness in a free condition in accordance with formula (1) since it is compressed by the force of the same magnitude as the magnitude of the tensile force acting on tubular element 101.

However, since cross sectional moment of inertia of a bending member is proportional to the fourth power of its cross sectional diameter, effect of the internal ice column on the overall bending stiffness of structural element 101 in FIG. 1 would be minimal. This effect is further minimized firstly by the fact that critical force for the internal column is very high due to supporting action of the side wall of tubular element 101 on the internal column, and also by the fact that Young's modulus of ice is usually much lower than that of the material constituting tubular element 101. Since $P_{cr}$ is fast decreasing with increasing length of a beam having given cross sectional dimensions, the stiffening effect for the same P, as stipulated by expression (2), will be more pronounced for more slender structural components. The ultimate case is a string whose pitch (i.e., bending stiffness ) is very dependent on the tensile (stretching) force, and whose bending stiffness can be changed by varying the tensile force by an order of magnitude or more, depending on its strength.

A more uniform stretching effect of the expanding ice column 102 on tubular element 101 will be achieved if internal walls of tubular element 101 were lubricated with a material not mixing with water/ice and not losing its lubricity at the freezing temperatures (e.g., silicone grease). The same role can be played by a coating/lining of the internal walls with a material with low shear resistance, such as an elastomeric (rubber-like) material.

Figure 3:
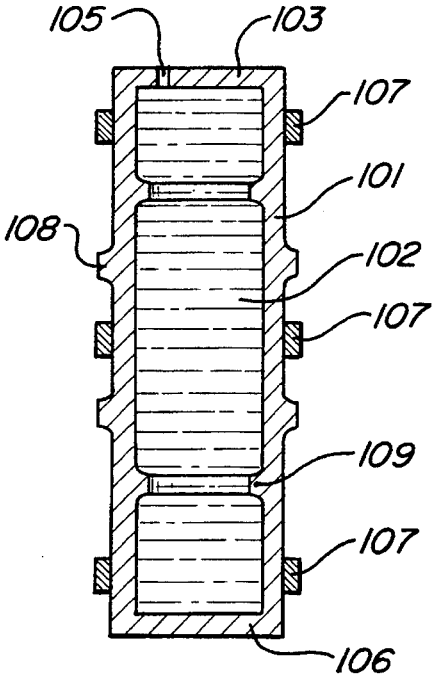
FIG. 3 is an axial section of another embodiment of the proposed invention, in which the transformable material is liquid while in the stressed condition.

Draining (bleeding) hole (passage) 105 can be used also for filling internal cavity of tubular element 101 with the transformable material 102 (e.g., water). Then a permanently attached cover or integral cover 106 in FIG. 3 replaces threaded plug 104 as in FIG. 1. Hole 105 can be blocked by external means (small threaded plug) or by the solidified transformable material at a designated moment during or after the transformation process.

To alleviate the undesirable effects of omnidirectional expansion of the material undergoing phase transformation tubular element 101 may be reinforced in critical cross sections (permanently or for the duration of the phase transformation process of the transformable material). Such reinforcement can be effected by various means, such as by removable collars 107 in FIG. 3, or by external (108 in FIG. 3) and/or internal (109 in FIG. 3) shape modifications of tubular element 101. Such reinforced structure can be used for solid/liquid transformation of the transformable material 102 in cases when its liquid phase has a larger specific volume than its solid phase. Since a compressed liquid exerts pressure in all directions, absence of reinforcements may lead to undesirable bulging of tubular element 101.

Figure 4:
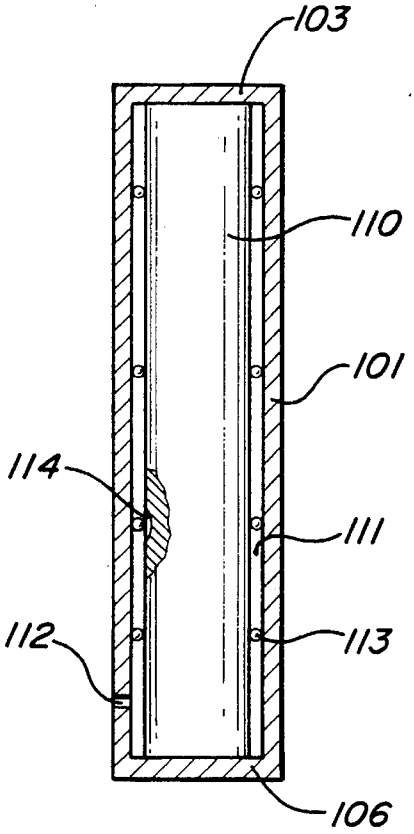
FIG. 4 is an axial section of yet another embodiment of the proposed invention in which a gaseous or fluid substance should be added to the transformable material in order to induce the transformation.

While the described above solid/liquid phase transformation of the transformable material would cause the desirable effect of tensile loading of the external tubular element 101 (using water-ice transformation, solidification of so-called fusible alloys which are contracting during solidification but after a short time demonstrate a gradual expansion, etc.), there are other types of transformations and chemical reactions which Can create the same effect. An example of the former is transformation from white to gray structure of tin which is associated with about 20% volume increase. While the transformation occurs at low temperatures (below 13° C. ), the gray phase of tin remains stable at much higher temperatures. Change of crystallic structure of materials (such as austenitic vs. martensitic structure in iron-based alloys) is also associated with the volumetric change. Absorbtion of gaseous or fluid substances by solid (metal) bodies or chemical reactions between gases/fluids and metal (or other solid) bodies may result in an increase of volume. An example is a chemical reaction of titanium with hydrogen which results in a significant increase of volume of the titanium core (110 in FIG. 4), up to 10–20%. In such cases, a small clearance 111 can be provided between core 110 and walls of tubular element 101. An orifice (passage) 112 allows for feeding reacting gaseous or fluid medium (e.g. hydrogen in the case of titanium core)into the cavity containing core 110.

The same effect can be achieved by precooling of internal rod 102 in FIG. 1 and inserting it into cavity of tubular element 101 which may be preheated for a further intensification of the stiffness-enhancing effect. After the insertion, plug 104 is tightened.

Connectors (spacers) 113, having high compresssion (radial) stiffness and, preferably, low shear (axial) stiffness, can be placed between transformable material core 110 and internal walls of tubular element 111. These spacers enhance stability of the core and prevent its buckling. These spacers, due to their low shear stiffness, are also playing a role of the lubricant allowing small displacements between core 110 and walls of tubular element 101. Connectors (spacers) 113 can be made of elastomeric materials (e.g., rubber O-rings, pads, etc.), rubber-metal laminated materials, etc. In case of O-rings and similar continuous devices, channels 114 can be provided in core 110 for a free passage of the required gas/fluid substances.

In some cases, either initial condition or the final condition of the transformable material is a bulk or powder condition. This condition occurs, for example, during transformation from white (solid) tin to gray (powder) tin.

It is readily apparent that the components of the system for enhancement of beam stiffness disclosed herein may take a variety of configurations. Thus, the embodiments and exemplifications shown and described herein are meant for illustrative purposes only and are not intended to limit the scope of the present invention, the true scope of which is limited solely by the claims appended hereto.

I claim:

1. Structural component subjected to bending load and comprising an elongated tubular element having a closed internal cavity filled with a material exerting axial tensile force on said tubular element while being itself subjected to axial compression force as a result of transformation increasing the volume of said material.

2. Structural component as claimed in claim 1 wherein said material is capable of undergoing said transformation between its solid and molten phases.

3. Structural component as claimed in claim 1 wherein said material is capable of developing several crystallic structures and transformation between its various crystallic structures.

4. Structural component as claimed in claim 1 wherein said material is capable of absorbing gaseous substances.

5. Structural component as claimed in claim 1 wherein said material is capable of absorbing fluid substances.

6. Structural components as claimed in claim 1 wherein said material is capable of undergoing chemical association with an externally fed substance.

7. Structural component as claimed in claim 1 wherein said tubular element is reinforced by removable external collars providing stability of its cross sectional shape under the influence of the increasing volume of said material during the course of said transformation.

8. Structural component as claimed in claim 1 wherein side surface of said tubular element is locally reinforced in order to provide stability of its cross sectional shape under the influence of the increasing volume of said material.

9. Structural component as claimed in claim 1 wherein said material is capable of undergoing transformation between its solid and molten phases and volume of said material in its solid state is larger than its volume in molten state.

10. Structural component as claimed in claim 1 wherein said material is composed of tin undergoing transformation between its white and gray phases.

11. Structural component as claimed in claim 1 wherein said material is composed of titanium undergoing absorption of hydrogen.

12. Structural component as claimed in claim 1 wherein said transformation is effected by thermal expansion of said material.

13. Structural component subjected to bending load, comprising:

an elongated tubular element having a closed internal cavity filled with a material exerting axial tensile force on said tubular element while being itself subjected to axial compression force as a result of transformation increasing the volume of said material;

said internal cavity being connected with environment by a passage.

14. Structural component as claimed in claim 13 wherein said internal cavity is connected with environment by a passage which is blocked after said transformation is effected.

15. Structural component as claimed in claim 13 wherein said internal cavity is connected with environment by a passage which is blocked at a designated moment.

16. Structural component subjected to bending load, comprising:

an elongated tubular element having a closed internal cavity;

said cavity filled with a material exerting axial tensile force on said tubular element while being itself subjected to axial compression force as a result of transformation increasing the volume of said material;

side surfaces of said material being separated form internal walls of said tubular element by a clearance.

17. Structural component as claimed in claim 16 wherein said clearance is filled with a lubricant which remains operative during the process of said transformation.

18. Structural component as claimed in claims 16 wherein said clearance contains deformable elements whose stiffness is high in radial direction and low in axial direction.

19. Structural component as claimed in claim 16 wherein said clearance contains deformable elements whose stiffness is high in radial direction and low in axial direction and said material has channels for providing access of external media to all parts of said material.

* * * * *